US009725657B2

(12) United States Patent
Sirota

(10) Patent No.: US 9,725,657 B2
(45) **Date of Patent: *Aug. 8, 2017**

(54) PROCESS FOR ENHANCING FEED FLEXIBILITY IN FEEDSTOCK FOR A STEAM CRACKER

(71) Applicant: ExxonMobil Research and Engineering Company, Annandale, NJ (US)

(72) Inventor: Eric B. Sirota, Flemington, NJ (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 76 days.

This patent is subject to a terminal disclaimer.

(21) Appl. No.: 13/628,345

(22) Filed: Sep. 27, 2012

(65) Prior Publication Data

US 2014/0083906 A1 Mar. 27, 2014

(51) Int. Cl.
*C10G 47/32* (2006.01)
*C10G 9/36* (2006.01)

(52) U.S. Cl.
CPC ..... *C10G 9/36* (2013.01); *C10G 2300/1044* (2013.01); *C10G 2300/20* (2013.01); *C10G 2300/4056* (2013.01); *C10G 2300/4081* (2013.01); *C10G 2400/20* (2013.01)

(58) Field of Classification Search
CPC ..... C10G 9/36; C10G 75/00; C10G 2300/20; C10G 2300/4056; C10G 2300/4081; C10G 2300/1044; C10G 2400/20
USPC ..... 208/92, 106, 128, 130
See application file for complete search history.

(56) References Cited

U.S. PATENT DOCUMENTS

| | | | | |
|---|---|---|---|---|
| 4,853,337 | A | 8/1989 | Dickakian | |
| 5,871,634 | A | 2/1999 | Wiehe et al. | |
| 5,997,723 | A | 12/1999 | Wiehe et al. | |
| 7,138,047 | B2 | 11/2006 | Stell et al. | |
| 7,951,340 | B2 | 5/2011 | Brons et al. | |
| 8,057,663 | B2 * | 11/2011 | Stell et al. | 208/130 |
| 2007/0100082 | A1 * | 5/2007 | Dickakian et al. | 525/333.7 |

(Continued)

FOREIGN PATENT DOCUMENTS

| | | | |
|---|---|---|---|
| FR | 2768154 | A1 | 3/1999 |
| WO | 2005113716 | A2 | 12/2005 |
| WO | 2011087877 | A2 | 7/2011 |

OTHER PUBLICATIONS

Irwin A. Wiehe, Raymond J. Kennedy and Ghazi B. Dickakian, "Fouling of Nearly Incompatible Oils", Symposium on Heavy Oil and Resid Compatibility and Stability presented Before the Division of Petroleum Chemistry, Inc. 221st National Meeting, American Chemical Society, San Diego, CA, Apr. 1-5, 2001, pp. 92-94.

(Continued)

*Primary Examiner* — Prem C Singh
*Assistant Examiner* — Brandi M Doyle

(57) ABSTRACT

Provided is a process for cracking a hydrocarbon feedstock. The process having the steps of (a) continuously passing the feedstock through a vapor-liquid separator in which the feedstock is separated into a volatile stream and a non-volatile stream; (b) continuously passing the non-volatile stream to a cracker; and (c) continuously recycling a portion of the volatile stream to the feedstock. There is also an apparatus for cracking a hydrocarbon feedstock.

8 Claims, 1 Drawing Sheet

(56) References Cited

U.S. PATENT DOCUMENTS

| | | | | |
|---|---|---|---|---|
| 2007/0163921 | A1* | 7/2007 | Keusenkothen | C10L 1/00 208/6 |
| 2009/0321324 | A1 | 12/2009 | Sharma et al. | |
| 2010/0300936 | A1* | 12/2010 | Stell et al. | 208/130 |

OTHER PUBLICATIONS

Parviz Rahimi, Kamran Akbarzadeh, Bok Der, Teclemariam Alem and Zhanyao Ha, "Fouling Reduction of Unstable Crude by Addition of Bitumen", Abstract of Papers, 231st ACS National Meeting, 2006 (abstract).

PCT Application No. PCT/US2013/058152, Communication from the International Searching Authority, Form PCT/ISA/210, dated Dec. 13, 2013, 3 pages.

* cited by examiner

PROCESS FOR ENHANCING FEED FLEXIBILITY IN FEEDSTOCK FOR A STEAM CRACKER

FIELD

The disclosure relates to a process for enhancing feed flexibility in feedstocks for a steam cracker.

BACKGROUND

Steam cracking has long been used to crack various hydrocarbon feedstocks into olefins. Conventional steam cracking utilizes a pyrolysis furnace having two primary sections: a convection section and a radiant section. The hydrocarbon feedstock typically enters the convection section of the furnace as a liquid (except for light feedstocks that enter as a vapor), wherein it is typically heated and vaporized by indirect contact with hot flue gas from the radiant section and by direct contact with steam. The vaporized feedstock and steam mixture is then introduced into the radiant section where the cracking takes place. The resulting cracked products, including olefins, leave the pyrolysis furnace for further downstream processing, such as quenching.

Hydrocarbon feedstocks to be cracked may come from a variety of internal and external sources and typically differ in composition. Crude petroleum feedstocks also differ in composition. Inconsistency in composition between multiple feedstocks can result in incompatibility and precipitation, particularly of asphaltenes.

Asphaltene precipitation can result in the deposition of organic solids, such as foulant and coke, on equipment such as refinery process equipment that contact the oil. Even small amounts of foulant or coke on equipment surfaces can result in energy loss because of fouled heat transfer surfaces. Moderate fouling can cause high pressure drop and interfere with and/or make equipment operation inefficient. Significant fouling may plug up equipment, which may prevent or impede flow and require equipment to be shut down and cleaned.

It would be desirable to have a process for cracking hydrocarbon feedstocks in which the incidence of asphaltene precipitation is substantially reduced or eliminated.

SUMMARY

According to the present disclosure, there is provided a process for cracking a hydrocarbon feedstock. The process has the steps of (a) continuously passing the feedstock through a vapor-liquid separator in which the feedstock is separated into a volatile stream and a non-volatile stream; (b) continuously passing the volatile stream to a steam cracker; and (c) continuously recycling a portion of the non-volatile stream to the feedstock.

According to the present disclosure, there is provided an apparatus for cracking a hydrocarbon feedstock. The apparatus has a vapor-liquid separator and a steam cracker. The vapor-liquid separator has an inlet conduit, a first outlet conduit and a second outlet conduit. The inlet conduit is adapted to convey the feedstock to the vapor-liquid separator. The first outlet conduit is adapted to remove a volatile stream from the vapor-liquid separator. The second outlet conduit is adapted to remove a non-volatile stream.

BRIEF DESCRIPTION OF THE DRAWINGS

To assist those of ordinary skill in the relevant art in making and using the subject matter hereof, reference is made to the appended drawings, wherein.

DETAILED DESCRIPTION

Figure 1:
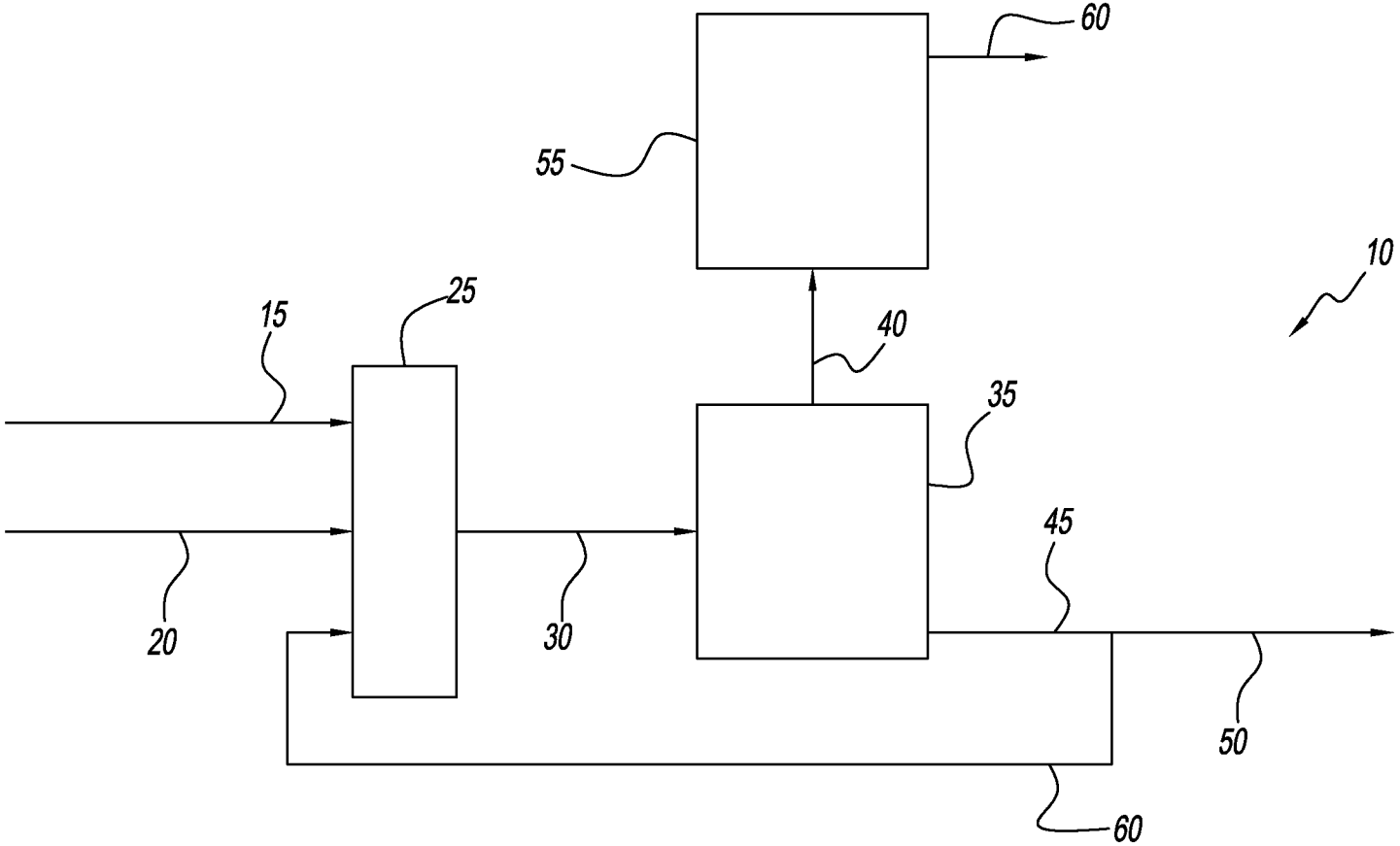
FIG. 1 is a schematic diagram of the process of the present disclosure.

All numerical values within the detailed description and the claims herein are modified by "about" or "approximately" the indicated value, and take into account experimental error and variations that would be expected by a person having ordinary skill in the art.

Asphaltenes are hydrocarbons that are the n-heptane insoluble, toluene-soluble component of a carbonaceous material such as crude oil, bitumen or coal. One practical test to determine if a feedstock contains asphaltenes is to test whether the oil is fully soluble when blended with 40 volumes of toluene but forms two phases when the oil is blended with 40 volumes of n-heptane. If yes, the oil contains asphaltenes. Asphaltenes may be composed of carbon, hydrogen, nitrogen, oxygen, and sulfur as well as trace amounts of vanadium and nickel. The carbon to hydrogen ratio is generally 1:12 depending on the source, but other ratios are possible.

A hydrocarbon feedstock or mixture of feedstocks may be described as incompatible if asphaltenes precipitate under most conditions. A hydrocarbon feedstock or mixture of feedstocks may be described as near-incompatible if it is close to the limit of incompatibility or becomes incompatible under certain conditions, e.g., relatively minor changes in temperature and pressure, such that asphaltenes precipitate to a significant degree. If the conditions and constitution of the stream are above the limit of compatibility, then the asphaltenes will not drop out of the stream.

Methods are available to predict whether a hydrocarbon feedstock or a mixture of feedstocks is compatible or not. One such method is disclosed in U.S. Pat. No. 5,871,634 and includes determining an insolubility number ($I_N$) and the solubility blending number ($S_{BN}$) for each hydrocarbon feedstock to be admixed. $S_{BN}$ is a measure of the asphaltene-solubilizing power of a hydrocarbon feedstock. $I_N$ is a measure of the solubilizing power necessary to keep the asphaltenes in the hydrocarbon feedstock. The first step in determining the $I_N$ and the $S_{BN}$ for a hydrocarbon feedstock is to establish if the feedstock contains n-heptane insoluble asphaltenes. The $I_N$ of a blend is the maximum $I_N$ of any component in the blend. This may be carried out by mixing 1 volume of the feedstock with 5 volumes of n-heptane and determining if asphaltenes are insoluble. Any convenient method might be used. One possibility is to observe a drop of the blend of test liquid mixture and feedstock between a glass slide and a glass cover slip using transmitted light with an optical microscope at a magnification of from 50 to 600 times. If the asphaltenes are in solution, few, if any, dark particles will be observed. If the asphaltenes are insoluble, many dark, usually brownish, particles, usually 0.5 to 10 microns (μm) in size, will be observed. Another possible method is to put a drop of the blend of test liquid mixture and feedstock on a piece of filter paper and allow it to dry. If the asphaltenes are insoluble, a dark ring or circle will be seen in the center of the yellow-brown spot made by the feedstock. If the asphaltenes are soluble, the color of the spot made by the feedstock will be relatively uniform in color.

The $S_{BN}$ of the mixture of a hydrocarbon feedstock(s) and vapor-liquid separator stream bottoms can be calculated by their relative volume fractions (V) and the $S_{BN}$ of each of the individual streams. For instance, for a process in which two different hydrocarbon streams ($V_1$ and $V_2$) and a single vapor-liquid separator stream bottom ($V_B$) are being admixed and conveyed to the vapor-liquid separator, the steady state $S_{BN}$ of the mixture may be calculated as follows:

$$V_1+V_2+V_B=1$$

$$S_{BN,feed}=(V_1)(S_{BN,1})+V_2(S_{BN,2})+V_B(S_{BN,B})$$

$$S_{BN,B}=S_{BN,feed}+c$$

$$S_{BN,feed}=[(V_1)(S_{BN,1})+V_2(S_{BN,2})+(1-V_1-V_2)(c)]/(V_1+V_2)$$

wherein "c" is a positive constant. "c" is the amount that the $S_{BN}$ increases on going from the hydrocarbon feedstock to the separator bottoms. $S_{BN}$ of the separator bottoms is higher than that of the feedstock because the components of the volatile stream of the separator are typically of lower density and are less aromatic than the components of the non-volatile separator bottoms. Thus, recycling of separator bottoms enhances the $S_{BN}$ of the feedstock entering the separator.

An embodiment of the process of the present disclosure is illustrated schematically by way of example in FIG. 1 and is generally referenced by the numeral 10. Two different crude oil feedstock streams 15 and 20 are conveyed to a mixer 25 to produce a feedstock stream 30, which is conveyed to vapor-liquid separator 35. If desired, feedstock stream 30 may be pre-heated prior to conveyance to mixer 25 (not shown). Stream 30 is separated into a volatile vapor stream 40 and a non-volatile liquid stream 45. A portion of stream 45 is recycled via stream 60 to mixer 25 to be admixed with feedstock streams 15 and 20. Stream 40 is conveyed to a steam cracker 55 to crack the volatile hydrocarbons into lighter hydrocarbons, such as $C_{2-6}$ olefins, in the form of cracked hydrocarbon stream 60. The remaining portion of stream 45 is a liquid hydrocarbon stream that can be processed to form petroleum-based products such as asphalt, lubricants, and fuel oil.

The portion of the non-volatile stream recycled to the vapor-liquid separator acts to compatibilize the hydrocarbon feedstock(s) to substantially reduce or eliminate asphaltene precipitation. The amount of the non-volatile stream recycled to the separator can be of any portion or ratio, but must be high enough to enhance compatibilization yet low enough as to not substantially diminish economic benefit. The weight of the non-volatile stream recycled to the total weight of the feedstock entering the separator is preferably 2 to 50 percent and more preferably 5 to 30 percent. The recycled portion of the non-volatile stream may, if desired, be introduced directly to a mixer or upstream of a mixer along with one or more hydrocarbon feedstocks. The mixer may take the form of a static mixer or a dynamic mixer.

It was found surprising that recycle of a portion of the vapor-liquid separator bottoms would substantially reduce or eliminate asphaltene precipitation since the major constituent of the bottoms is asphaltenes. It is counterintuitive to recycle a constituent that is precipitating to begin with, i.e., a source of the processing problem. Although not bound by any theory, it is believed that the relatively high degree of aromaticity of the recycle vapor-liquid separator bottoms provides enhanced compabilization to feedstock streams, e.g., crude oil feedstocks (i.e., that c>0).

There is an embodiment of an apparatus for cracking a hydrocarbon feedstock. The apparatus has a vapor-liquid separator and a steam cracker. The vapor-liquid separator has an inlet conduit, a first outlet conduit and a second outlet conduit. The inlet conduit is adapted to convey the feedstock to the vapor-liquid separator. The first outlet conduit is adapted to remove a volatile stream from the vapor-liquid separator. The second outlet conduit is adapted to remove a non-volatile stream. With reference to FIG. 1, the inlet conduit corresponds to the inlet receiving feedstock stream 30. The first outlet conduit corresponds to the outlet conveying volatile hydrocarbon vapor stream 40. The second outlet conduit corresponds to the outlet conveying the non-volatile liquid hydrocarbon stream 45.

Any type of vapor-liquid separator know in the art as useful in separating liquid from vapor may be employed. Typically, the separator will separate volatile hydrocarbons from non-volatile or less-volatile hydrocarbons. The separator will provide output of one or more vapor streams and one or more liquid streams. A preferred vapor-liquid separator is a flash drum.

One flash drum or two or more flash drums in series may be employed. Typically, a single flash drum is used. The flash drum is preferably operated at 40 psia to 200 psia (275 kPa to 1400 kPa) pressure and at a temperature usually the same or slightly lower than the temperature of the feedstock stream entering the flash drum. Preferably, the operating temperature of the flash drum is 600° F. to 950° F. (310° C. to 510° C.). More preferably, the pressure of the flash drum vessel is 85 psia to 155 psia (600 to 1100 kPa) and the temperature is 700° F. to 920° F. (370° C. to 490° C.). Still more preferably, the pressure of the flash drum vessel is 105 psia to 145 psia (700 to 1000 kPa) and the temperature is 750° F. to 900° F. (400° C. to 480° C.). Most preferably, the pressure of the flash drum vessel is 105 psia to 125 psia (700 to 760 kPa) and the temperature is S 10° F. to 890° F. (430° C. to 480° C.). Depending on the temperature of the flash stream, usually 50 to 95% of the mixture entering the flash drum is vaporized to the upper portion of the flash drum, preferably 60 to 90% and more preferably 65 to 85%, and most preferably 70 to 85%. Typically, the hydrocarbon partial pressure of the vapor stream of the flash drum is set and controlled at between 4 and 25 psia (25 and 175 kPa), preferably between 5 and 15 psia (35 to 100 kPa), most preferably between 6 and 11 psia (40 and 75 kPa). Additional teachings to configuration and operation of flash drums are found in U.S. Pat. No. 7,138,047 B2, which is incorporated herein by reference in its entirety.

Steam cracking may be carried out according to processes known in the art, such as in a pyrolysis furnace. Methods for carrying out steam cracking are described for example, in U.S. Pat. No. 7,138,047 B2, which is incorporated herein in its entirety.

In addition to crude oil, hydrocarbon feedstocks useful in the process of the present disclosure may also include partial content of other refinery products and by-products, such as steam-cracked gas oil and residues, gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, Fischer-Tropsch gases, natural gasoline, distillate, virgin naphtha, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric residium, heavy residium, $C_4$/residue admixture, and naphtha residue admixture.

PCT/EP Clauses:

1. A process for cracking a hydrocarbon feedstock, comprising: (a) continuously passing the feedstock through a vapor-liquid separator in which the feedstock is separated into a volatile stream and a non-volatile stream; (b) continuously passing the volatile stream to a steam cracker; and (c) continuously recycling a portion of the non-volatile stream to the feedstock.

2. The process of clause 1, wherein the weight of the non-volatile stream recycled to the total weight of the feedstock is 2 percent to 50 percent.

3. The process of clauses 1 or 2, wherein the weight of the non-volatile stream recycled to the total weight of the feedstock is 5 percent to 30 percent.

4. The process of clauses 1-3, wherein two sub-feedstocks of different composition are conjoined or admixed to form the feedstock.

5. The process of clauses 1-4, wherein the feedstock is a crude oil feedstock.

6. The process of clause 4-5, wherein the two sub-feedstocks are crude oil feedstocks.

7. The process of clauses 1-6, wherein the feedstock is pre-heated prior to conveyance to the vapor-liquid separator.

8. The process of clause 7, wherein the vapor-liquid separator is a flash drum.

9. The process of clause 8, wherein the flash drum is operated at a temperature of 600° F. to 950° F. and an absolute pressure of 40 psia to 200 psia.

10. An apparatus for cracking a hydrocarbon feedstock, comprising:

a vapor-liquid separator having an inlet conduit, a first outlet conduit and a second outlet conduit, wherein the inlet conduit is adapted to convey the feedstock to the vapor-liquid separator, wherein the first outlet conduit is adapted to remove a volatile stream from the vapor-liquid separator and the second outlet conduit is adapted to remove a non-volatile stream and a steam cracker.

All patents and patent applications, test procedures (such as ASTM methods, UL methods, and the like), and other documents cited herein are fully incorporated by reference to the extent such disclosure is not inconsistent with this disclosure and for all jurisdictions in which such incorporation is permitted.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

What is claimed is:

1. A process for cracking an incompatible or near-incompatible hydrocarbon feedstock wherein asphaltenes precipitate, comprising:

(a) continuously passing the incompatible or near-incompatible feedstock and the recycle portion of the non-volatile stream through a vapor-liquid separator in which the feedstock is separated into a volatile stream and a non-volatile stream;

(b) continuously passing the volatile stream to a steam cracker;

(c) continuously recycling a portion of the non-volatile stream to the feedstock;

(d) increasing the amount of the non-volatile stream recycled to the feedstock sufficient to reduce or eliminate asphaltene precipitation, wherein the feedstock is a crude oil feedstock and the asphaltenes are derived from crude oil.

2. The process of claim 1, wherein the weight of the non-volatile stream recycled to the total weight of the feedstock is 2 percent to 50 percent.

3. The process of claim 1, wherein the weight of the non-volatile stream recycled to the total weight of the feedstock is 5 percent to 30 percent.

4. The process of claim 1, wherein two sub-feedstocks of different composition are conjoined or admixed to form the feedstock.

5. The process of claim 4, wherein the two sub-feedstocks are crude oil feedstocks.

6. The process of claim 1, wherein the feedstock is pre-heated prior to conveyance to the vapor-liquid separator.

7. The process of claim 6, wherein the vapor-liquid separator is a flash drum.

8. The process of claim 7, wherein the flash drum is operated at a temperature of 600° F. to 950° F. and an absolute pressure of 40 psia to 200 psia.

* * * * *